US006789518B2

(12) United States Patent
Buhl et al.

(10) Patent No.: US 6,789,518 B2
(45) Date of Patent: Sep. 14, 2004

(54) METHOD AND SYSTEM FOR IDENTIFYING VALVE CLEARANCES AND POSITION OF VALVE OPENING CAMS

(75) Inventors: Georg Buhl, Munich (DE); Markus Mueller, Groebenzell (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 10/300,910

(22) Filed: Nov. 21, 2002

(65) Prior Publication Data

US 2003/0145813 A1 Aug. 7, 2003

(30) Foreign Application Priority Data

Nov. 23, 2001 (DE) ..... 101 57 514

(51) Int. Cl.[7] ..... F01L 1/34

(52) U.S. Cl. ..... 123/90.15; 73/35.09; 73/645; 324/378; 324/379

(58) Field of Search ..... 73/1.82, 117.2, 73/117.3, 119 R, 579, 587, 593, 645, 12.01, 35.09, 35.11; 324/378–380, 384, 393, 402

(56) References Cited

U.S. PATENT DOCUMENTS 4,483,185 A * 11/1984 Kunzfeld ..... 73/117.2
4,995,365 A * 2/1991 Denz et al. ..... 123/479
5,797,360 A * 8/1998 Pischinger et al. ..... 123/90.11

FOREIGN PATENT DOCUMENTS

| | | |
|---|---|---|
| JP | 4-112908 | 4/1992 |
| JP | 7-238822 | 9/1995 |
| JP | 9-72208 | 3/1997 |
| JP | 10-288017 | 10/1998 |

OTHER PUBLICATIONS

Japanese Patent Publication 09–072208, Hideo, Mar. 18, 1997, "Valve Clearance Detecting Device".*

U.S. patent application Publication 2002/0095978 A1, Jul. 2002, Muhlberger et al., 73/117.3, "Method for Assessing the Phase Angle of a Camshaft of an Internal Combustion Engine, In Particular for a Motor Vehicle".*

* cited by examiner

*Primary Examiner*—Thomas Denion
*Assistant Examiner*—Kyle M. Riddle
(74) *Attorney, Agent, or Firm*—Crowell & Moring LLP

(57) ABSTRACT

In a method and system, the condition of a valve drive, particularly of valve clearance, and the position of at least one valve opening cam of a cam shaft of an internal combustion engine are recorded from processing signals which are generated by at least one impact sound sensor such as an electronic spark sensor. Preferably, at least one characteristic signal sequence is identified from signals generated by the impact sound sensor. The sequence occurs at a particular time during a cycle of the internal combustion engine, and is compared to a stored reference signal. As a result, the condition of a valve drive, e.g. the valve clearance, and/or the position of at least one valve opening cam of the cam shaft can be deduced.

25 Claims, 1 Drawing Sheet

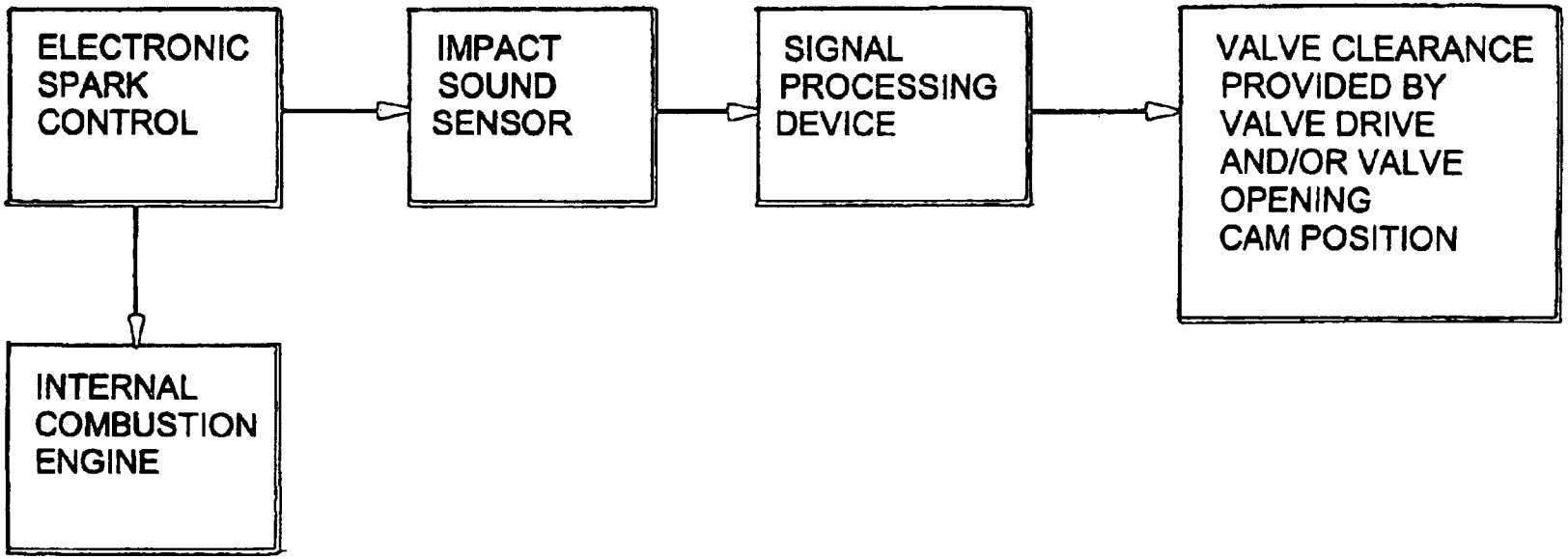
ELECTRONIC SPARK CONTROL
IMPACT SOUND SENSOR
SIGNAL PROCESSING DEVICE
VALVE CLEARANCE PROVIDED BY VALVE DRIVE AND/OR VALVE OPENING CAM POSITION
INTERNAL COMBUSTION ENGINE

METHOD AND SYSTEM FOR IDENTIFYING VALVE CLEARANCES AND POSITION OF VALVE OPENING CAMS

This application claims the priority of German application 101 57 514.9, filed Nov. 23, 2001, the disclosure of which is expressly incorporated by reference herein.

BACKGROUND AND SUMMARY OF THE INVENTION

The present invention relates to a method and a system for identifying a valve clearance of an internal combustion engine and for recording the actual position of a valve opening cam of an engine with or without a cam shaft adjusting system.

Usually, valve clearances on the load change indicators of internal combustion engines are only measured during regular inspections of the internal combustion engines and corrected, if necessary. Generally, inspections are done at intervals as recommended by the engine manufacturer (e.g. distance traveled or operating time). Another possible alternative for determining the inspection intervals is based on an evaluation and display device installed in a vehicle which, for example, registers the distance, operating time, and operating conditions of internal combustion engine usage (e.g. frequent cold start, short operation time, run time duration with heavy loads or revolutions per minute), analyzes the like, and, accordingly, indicates the necessity of an inspection.

None of these known systems considers the actual conditions of different components of the combustion engine, which are usually checked and adjusted in the course of an inspection. Since, when determining the time of the inspection, the actual condition of the components that are to be inspected and, if necessary, adjusted in their settings is not considered, and since this determination is made based only upon experiences and observations that were established on the basis of running distance or operating time, at best, while taking the operating circumstances into consideration, the inspection that is initiated in practice rarely occurs at the right time. In order to avoid damage to components, the inspection time is therefore normally selected such that, even with intensely stressful usage of the combustion engine, the inspection is performed before reaching a critical condition in order to prevent failures and the resulting cost of downtime and repair. Accordingly, the inspections usually occur too early, which causes unnecessary costs, especially when considering the total of all inspections in the life span of the internal combustion engine. Beyond that is the fact that unexpected changes, which necessitate an inspection, are not registered and reported. For example, it may not be detected when the valve clearance of the load change indicators changes excessively and therefore danger exists that further operation of the engine could result in damaging the internal combustion engine.

Beyond that, in internal combustion engines with or without cam shaft adjusting systems, the actual positions of the valve opening cams are conventionally detected with the help of position sensors on the cam shaft. This requires the existence of one or more sensors, transmitters, cabling, and analyzing circuits and software in a control unit. In view of the many necessary components for recording the actual position of the valve opening cam, such cam shaft adjusting systems are relatively complex and expensive.

One object of the present invention is to provide an improved method and system for recording the valve clearance of the load change indicators, and/or the actual position of the valve opening cams of the cam shaft. This can be realized, while avoiding costs for additional components, by being able to access the components already existing in the vehicle (e.g. sensors) in order to obtain information, about the valve clearance of the load change indicator and/or the actual position of the valve opening cam of the cam shaft. This task is accomplished by the features of the present invention.

BRIEF DESCRIPTION OF THE DRAWING

The single drawing figure schematically illustrates by way of example systems for identifying a valve clearance according to the invention.

DETAILED DESCRIPTION OF THE INVENTION

One fundamental idea of the invention is that, in internal combustion engines with or without automatic valve clearance compensation and/or in internal combustion engines with or without cam shaft adjusting systems, the signals generated by the impact sound sensors can be used to draw conclusions about the condition of the valve drive of the load change indicators and/or the actual position of the valve opening cams of the cam shaft based on characteristic signal sequences that occur at certain times.

The present invention is therefore based on the knowledge that, in internal combustion engines which contain an engine management system with electronic spark control via impact sound sensors, the signal produced by the impact sound sensors can be used, based on characteristic signal sequences that occur at certain times, to draw conclusions about the sound radiation of the valve drive of the load change indicators and therefore about the actual valve clearance and/or about the moment of the occurrence of the characteristic sound radiation in relation to the position of the crankshaft and, consequently, to draw conclusions about the exact position of the valve lifting cams. Thus, apart from the determination of the valve clearance, the actual position of the cam shaft can additionally be determined in order to deduce the valve timing and to be able to synchronize the operating cycle.

For this purpose, at least one area, preferably several areas, from the progression of the crankshaft rotation, in which the characteristic impact sound can be found on the impact sound sensor, will be chosen. In these areas the engine management system compares the sequence of the signals with memorized differentiation signals and accordingly decides whether the valve settings are in the admissible range or whether the positions of the valve lifting cams is correct. For that purpose, preferably, several areas from the progression of the crankshaft rotation are chosen such that all valves of the load change indicators, all together or separate, can be recorded and analyzed.

The ability to evaluate the recorded impact sound signals of the load change indicator valves is particularly supported by the fact that the levels at the beginning and towards the end of the valve lift caused by the cams of the cam shaft are designed for valve control from a design and production technology point of view such that the design supports not only the formation of characteristic impact noise sequences at too great and/or too small valve clearances, but that it results in a different characteristic impact sound sequence at a correct valve clearance. In this way, the identification and evaluation of valve clearance and/or position of the valve opening cams can take place in a reproducible manner with the help of an impact sound sensor, for example an electronic spark sensor, without requiring additional components.

Consequently, according to the method and system of the invention, the identification of impermissible or defective valve clearance, and therefore the avoidance of potential defects of components, can be guaranteed without the need for an inspection of the internal combustion engine. Rather, protection of components through early detection of risks for the components, due to a dependable and reproducible diagnosis in the engine, results. Additionally, the frequency of inspection work is therefore limited to the necessary minimum. This results in considerable cost savings in the maintenance of internal combustion engines.

Beyond that, the invention enables the identification of the actual position of the cams of the cam shafts, allowing a conclusion about the actual control times, wherein no additional sensors are required. This is especially significant for engines with cam shaft or control time adjusting systems, because in this way additional sensors, transmitters, cabling, as well as analyzing circuits and software in a control unit can be foregone. Moreover, with the detection of the actual position of the cam, it is possible to synchronize the operating cycle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for identifying a valve clearance provided by a valve drive of an internal combustion engine comprising processing signals which are generated by at least one impact sound sensor, wherein said impact sound sensor is an electronic spark sensor which also serves in electronic spark control of the internal combustion engine.

2. A method for identifying a position of at least one valve opening cam of a cam shaft of an internal combustion engine comprising processing signals which are generated by at least one impact sound sensor, wherein said impact sound sensor is an electronic spark sensor which also serves in electronic spark control of the internal combustion engine.

3. A method for identifying a valve clearance provided by a valve drive and a position of at least one valve opening cam of a cam shaft of an internal combustion engine comprising processing signals which are generated by at least one impact sound sensor, and identifying at least one characteristic signal sequence which occurs at a certain time during a cycle of the internal combustion engine from the signals generated by the impact sound sensor.

4. A method for identifying a valve clearance provided by a valve drive and a position of at least one valve opening cam of a cam shaft of an internal combustion engine comprising processing signals which are generated by at least one impact sound sensor, wherein said impact sound sensor is an electronic spark sensor which also serves in electronic spark control of the internal combustion engine.

5. The method according to claim 2, and further comprising identifying at least one characteristic signal sequence which occurs at a certain time during a cycle of the internal combustion engine from the signals generated by the impact sound sensor.

6. The method according to claim 3 or claim 5, and further comprising comparing the at least one characteristic signal sequence to a stored reference signal.

7. The method according to claim 3 or claim 5, and further comprising determining at least one of an actually existing valve clearance and a position of the at least one valve opening cam.

8. The method according to claim 3 or claim 5, and further comprising extracting several characteristic signal sequences during one cycle of the internal combustion engine so that, for all valves of the internal combustion engine, at least one of actually existing valve clearances and positions of valve opening cams can be determined.

9. The method according to claim 8, and further comprising determining a position of an adjustable cam shaft based on the position of at least one of the valve opening cams.

10. The method according to claim 8, and further comprising determining positions of the valve opening cams in relation to a crankshaft signal based on positions of the valve opening cams determined, and determining whether a cylinder, which corresponds to one of the valve opening cams, is in the range of load changing impulses, compression, or operating cycles at the time a signal of the one of the valve opening cams is determined.

11. The method according to claim 10, and further comprising synchronizing at least one of ignition, injection, and an operating cycle of the internal combustion engine based on said determination.

12. A system for identifying a valve clearance provided by a valve drive of an internal combustion engine comprising at least one impact sound sensor, and a device for processing signals that are generated by the at least one impact sound sensor, wherein the at least one impact sound sensor is an electronic spark sensor which is connected with a device for electronic spark control of the internal combustion engine.

13. A system for identifying a position of at least one valve opening cam of a cam shaft of an internal combustion engine comprising at least one impact sound sensor, and a device for processing signals that are generated by the at least one impact sound sensor, wherein the at least one impact sound sensor is an electronic spark sensor which is connected with a device for electronic spark control of the internal combustion engine.

14. A system for identifying a valve clearance provided by a valve drive and a position of at least one valve opening cam of a cam shaft of an internal combustion engine comprising a device for processing signals that are generated by at least one impact sound sensor, wherein the device for processing the signals generated by the at least one impact sound sensor identifies at least one characteristic signal sequence which occurs at a certain time during a cycle of the internal combustion engine.

15. A system for identifying a valve clearance provided by a valve drive and a position of at least one valve opening cam of a cam shaft of an internal combustion engine comprising a device for processing signals that are generated by at least one impact sound sensor, wherein the at least one impact sound sensor is an electronic spark sensor which is connected with a device for electronic spark control of the internal combustion engine.

16. The system according to claim 13, wherein the device for processing the signals is an engine management system.

17. The system according to claim 13, wherein the device for processing the signals generated by the at least one impact sound sensor identifies at least one characteristic signal sequence which occurs at a certain time during a cycle of the internal combustion engine.

18. The system according to claim 14 or claim 17, and further comprising a storage device, wherein the device for processing the signals compares the at least one characteristic signal sequence to a reference signal which is stored in the storage device.

19. The system according to claim 14 or claim 17, wherein the device for processing the signals determines at least one of an actually existing valve clearance and a position of the at least one valve opening cam on the basis of the at least one characteristic signal sequence.

20. The system according to claim 19, wherein the device for processing the signals extracts several characteristic signal sequences during a cycle of the internal combustion engine so that actually existing valve clearances and the positions of valve opening cams are determined for all valves.

21. The system according to claim 20, wherein the device for processing the signals can determine the position of an adjustable cam shaft based on the positions of the valve opening cams.

22. The system according to claim 20, wherein the device for processing the signals can determine positions of these valve opening cams in relation to a crankshaft signal based on the positions of the valve opening cams determined, and determines whether a cylinder that corresponds to one of the valve opening cams is in a range of load change impulses, compression, or operating cycles at the time a signal of the one of the valve opening cams is being determined.

23. The system according to claim 22, wherein the device for processing the signals synchronizes with an operating cycle based on at least one of detection of ignition and injection in the internal combustion engine.

24. A system for identifying a valve clearance provided by a valve drive of an internal combustion engine comprising at least one impact sound sensor, and a device for processing signals that are generated by the at least one impact sound sensor, the signals from said at least one impact sound sensor being used to determine the valve clearance, wherein the device for processing the signals is an engine management system.

25. A system for identifying a valve clearance provided by a valve drive and a position of at least one valve opening cam a cam shaft of an internal combustion engine comprising a device for processing signals that are generated by at least one impact sound sensor, the signals from said at least one impact sound sensor being used to determine the valve clearance, wherein the device for processing the signals is an engine management system.

* * * * *